US007845280B2

(12) United States Patent
Caldwell

(10) Patent No.: US 7,845,280 B2
(45) Date of Patent: Dec. 7, 2010

(54) DIVERSIONARY DEVICE WITH VERTICALLY DEPLOYED PAYLOAD

(75) Inventor: Marcus L. Caldwell, Colorado Springs, CO (US)

(73) Assignee: Law Enforcement Technologies, Inc., Colorado Springs, CO (US)

( * ) Notice: Subject to any disclaimer, the term of this patent is extended or adjusted under 35 U.S.C. 154(b) by 198 days.

(21) Appl. No.: 12/268,574

(22) Filed: Nov. 11, 2008

(65) Prior Publication Data

US 2010/0275803 A1 Nov. 4, 2010

(51) Int. Cl.
*F42B 12/46* (2006.01)

(52) U.S. Cl. ..... 102/367; 102/482; 102/498

(58) Field of Classification Search ..... 102/367–370, 102/334, 482, 498
See application file for complete search history.

(56) References Cited

U.S. PATENT DOCUMENTS 3,238,143 A * 3/1966 Ainsley et al. ..... 102/334
5,824,945 A * 10/1998 Barlog et al. ..... 102/482
6,253,680 B1 7/2001 Grubelich
7,412,929 B2 * 8/2008 Walsh ..... 102/368
2006/0081147 A1 * 4/2006 Walsh ..... 102/368
2008/0216699 A1 * 9/2008 McAleer et al. ..... 102/367

* cited by examiner

*Primary Examiner*—Michael Carone
*Assistant Examiner*—Jonathan C Weber
(74) *Attorney, Agent, or Firm*—Law Office of Dan Shifrin, PC; Dan Shifrin

(57) ABSTRACT

A diversionary device has a housing having dimensions which are selected such that when the device is thrown or dropped, the device will come to rest only on one of its two primary sides. Each primary side has a circular dispersion port formed therethrough. The device includes means for blocking the first dispersion port if the device comes to rest on the first primary surface and for blocking the second dispersion port if the device comes to rest on the second primary surface. A firing mechanism is operable to discharge an ignitable composition out of a removable cartridge within the housing. The ignitable composition is discharged through the first dispersion port when the device rests on the second primary side and through the second dispersion port when the device rests on the first primary side. The composition then forms a cloud above the device and may be ignited.

7 Claims, 18 Drawing Sheets

DIVERSIONARY DEVICE WITH VERTICALLY DEPLOYED PAYLOAD

RELATED APPLICATION DATA

The present application is related to commonly-assigned and co-pending U.S. application Ser. Nos. 12/268,589, entitled REPLACEABLE CARTRIDGE FOR DIVERSIONARY DEVICE, 12/268,595, entitled SHOCK-STABILIZED FIRING MECHANISM FOR DIVERSIONARY DEVICE, 29/327,668, entitled DIVERSIONARY DEVICE, and 29/327,670, entitled DIVERSIONARY DEVICE, all filed on the filing date hereof, which applications are incorporated herein by reference in their entireties.

TECHNICAL FIELD

The present invention relates generally to diversionary devices, also known as stun grenades and flash-bang grenades and, in particular, to a diversionary device in which the payload is vertically deployed and ignited above the device.

BACKGROUND ART

Diversionary devices are used in a variety of military and law enforcement situations. Specifically, the device is intended to disorientate an adversary without inflicting permanent damage or harm. The device accomplishes this by producing a disorientating flash of light and a confusingly loud noise. Devices of this sort are often referred to as "stun grenades" or "flash-bang grenades."

For example, a diversionary device might be used by a police SWAT team during a sniper situation. After forcing open the door to the room in which the sniper is located, one of the team members will toss or roll a diversionary device into the room close to the suspect. After a brief delay, the device goes off, producing a bright flash that temporarily blinds and a loud noise that temporarily deafens the suspect. The effects of the flash and noise last only a second or two which is enough for the SWAT team to rush into the room and subdue the suspect.

While the concept is sound in theory, in practice conventional diversionary devices have a number of disadvantages. Conventional diversionary devices may be inherently unstable and subject to accidental or premature detonation, especially when thrown. The devices typically contains a metal powder that violently combines with an oxidizer. The resulting explosion occurs within the body of the device and creates a zone of extreme pressure. This overpressure may blow out windows and shred furniture. In addition, the explosion creates significant heat which can cause furniture and other items to burn and can even cause a major fire. Because conventional diversionary devices are typically cylindrical with dispersion ports at one or both ends, the explosive force and heat is substantially non-directional. Moreover, the explosion may also result in a recoil reaction by the device, causing it to shoot rapidly in an unpredictable direction. It will be appreciated, therefore, that the use of a diversionary device may result in serious injury to the user or to the suspect. In fact, numerous injuries have been documented to police and military personnel as well as to suspects, with the latter also resulting in costly litigation against jurisdictions.

SUMMARY OF THE INVENTION

The present invention provides a device for creating a diversion. The device has a housing having dimensions L, W and H which are selected such that when the device is thrown or dropped, the device will come to rest only on one of its two primary sides. The two primary sides each have a circular dispersion port formed therethrough and aligned with each other. The device includes means for blocking the first dispersion port if the device comes to rest on the first primary surface and for blocking the second dispersion port if the device comes to rest on the second primary surface. The device further includes a firing mechanism within the housing and operable to discharge an ignitable composition out of a removable cartridge within the housing. The ignitable composition is discharged through the first dispersion port when the device rests on the second primary side and through the second dispersion port when the device rests on the first primary side. After being discharged, the composition forms a cloud above the device and may be ignited.

DETAILED DESCRIPTION OF THE PREFERRED EMBODIMENT

The described features, structures or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials or operations are not shown or described in detail to avoid obscuring aspects of the invention. Furthermore, for clarity a component may be described as being "secured" or "attached" or "connected" to another component. However, it will be understood that other, intermediate, components may be used and that the described connections may be functional connections rather than necessarily being direct physical connections.

Housing

Figure 1A:
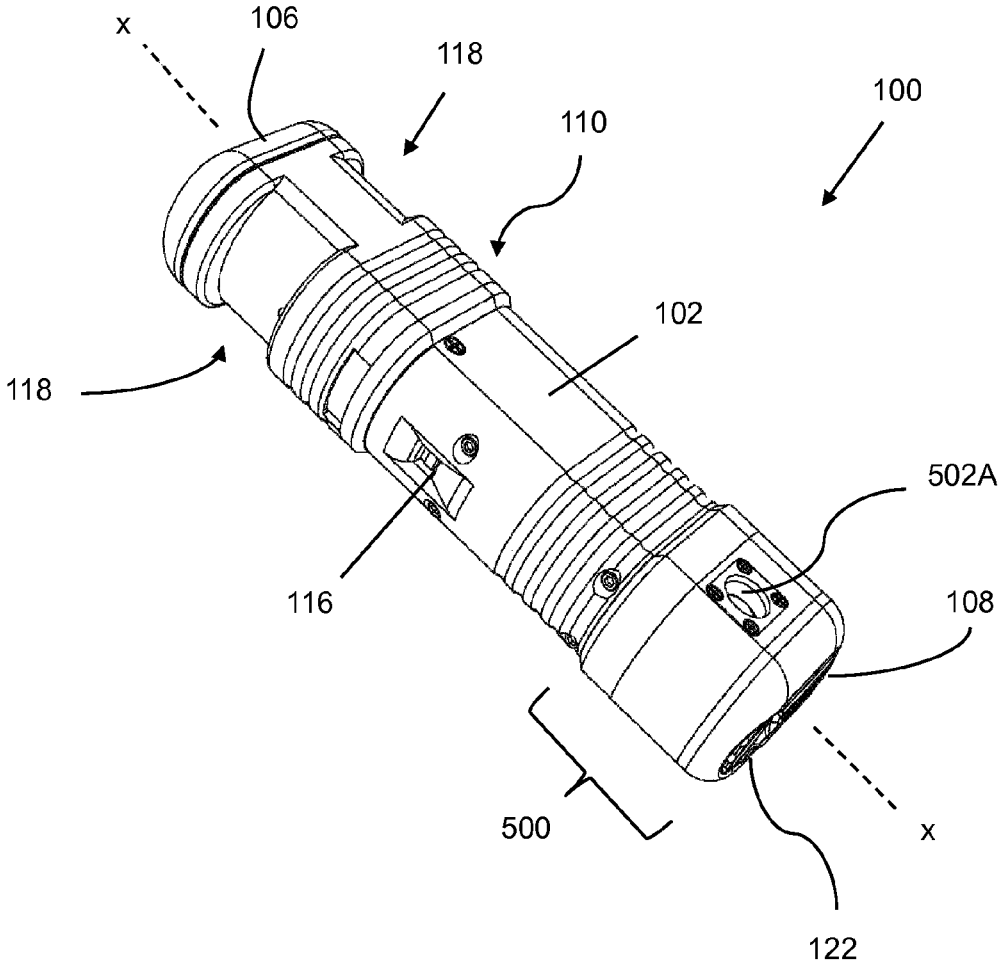
FIG. 1A is one perspective view of one embodiment of the diversionary device of the present invention.
Figure 1B:
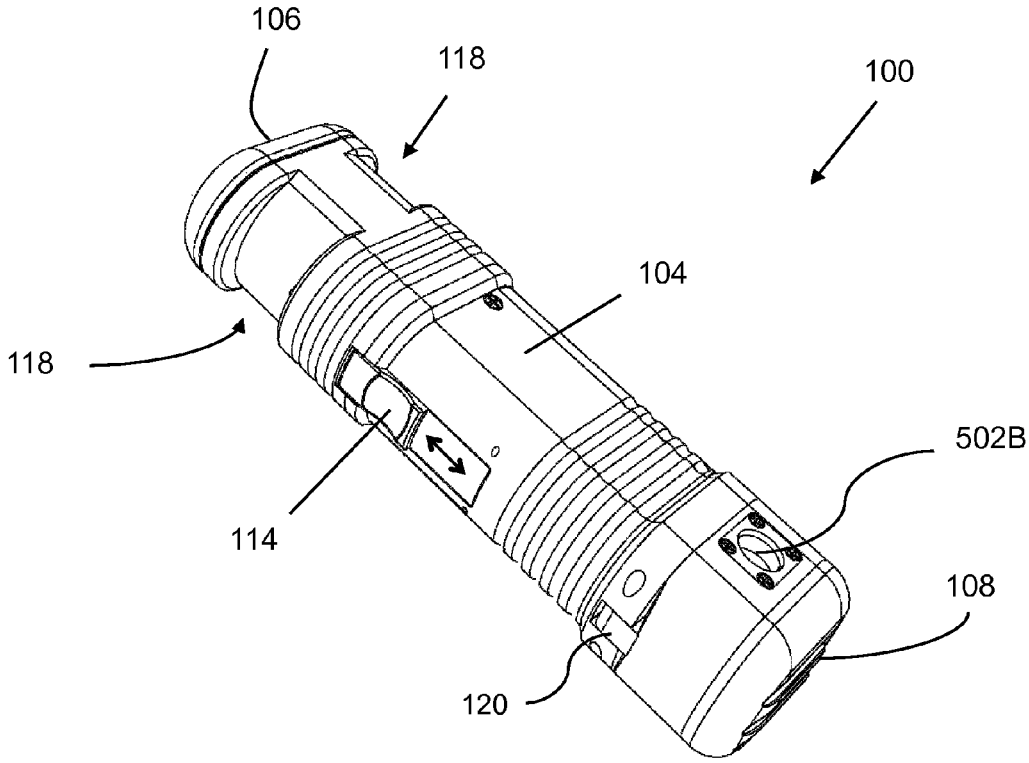
FIG. 1B is another perspective view of the diversionary device.
Figure 1C:
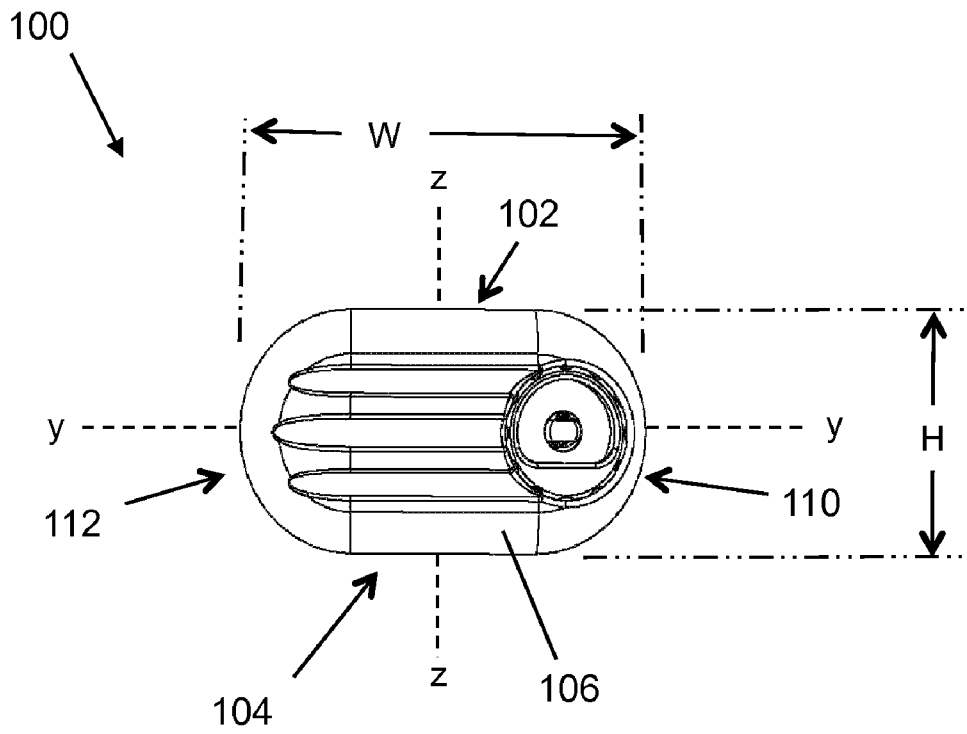
FIG. 1C is an end view of the diversionary device.
Figure 1D:
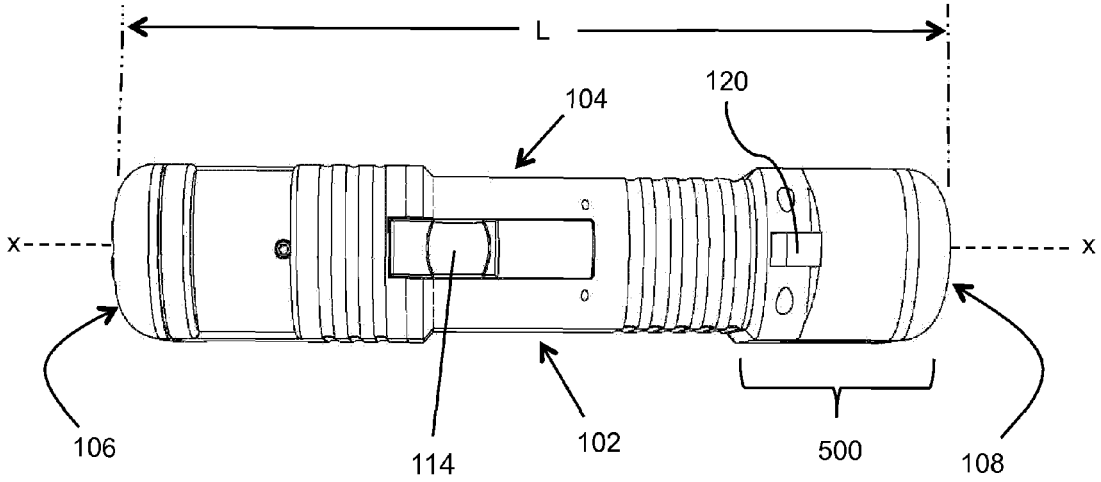
FIG. 1D is a side view of the diversionary device.

FIGS. 1A and 1B are perspective views of one embodiment of the housing 100 of the diversionary device of the present invention while FIGS. 1C and 1D are end and side views, respectively, of the housing. For purposes of convenience in describing the device 100, one of the two largest or primary surfaces of the housing 102 will be considered the "top" surface or side and the opposite surface 104 will be considered to be the "bottom" surface or side, with the length L of the device being parallel to a first axis x-x. Similarly, one of the two smallest surfaces 106, in planes orthogonal to the first and second primary sides will be considered to be the "front" end and the opposite surface 108 will be considered to be the "rear" end, with the width and height of the device being parallel to second and third axes y-y and z-z, respectively. And, of the two intermediate-sized surfaces of the housing 100, orthogonal to the first and second primary sides 102, 104 and to the front and rear ends 106, 108, one such surface 110 will be considered to be the "right" side and the opposite surface 112 will be considered to be the "left" side. It will be appreciated, however, that functionally, the designations "top," "bottom," "front," "rear," "left" and "right" are arbitrary and used herein only for description purposes.

A rear section 500 of the housing 100 includes a circular dispersion port 502A in the top surface 102 and another circular dispersion port 502B in the bottom surface 104, aligned with each other and centered on an axis parallel to the z-z axis. The length L of the device 100 is greater than the height H and the width W. The dimensions L, H and W are selected such that, when the device is thrown or rolled into a room or other area, it will come to rest on either the top 102 or bottom 104 side with one or the other of the dispersion ports 502, 504 facing upwards. Additionally, a slim profile enables the device to be more easily stored and carried. By way of example only, in one embodiment L=8 inches, H=1.5 inches and W=2.75 inches. It will be appreciated that the scope of the claims is not limited to these dimensions but that other dimensions will provide the benefit of the device coming to rest on the top or bottom surfaces when thrown or rolled.

An opening in the left side 112 of the housing 100 permits a trigger bar 114 to slide parallel to the x-x axis from a locked position (towards the front 106), in which the diversionary device is prevented from activating, to a ready position (towards the rear 108), which releases a hammer block and permits a trigger mechanism to operate, as will be explained in detail below. An opening in the right side 110 of the housing 100 permits a slide switch 116 to activate a timer, as will also be explained below.

Figure 1E:
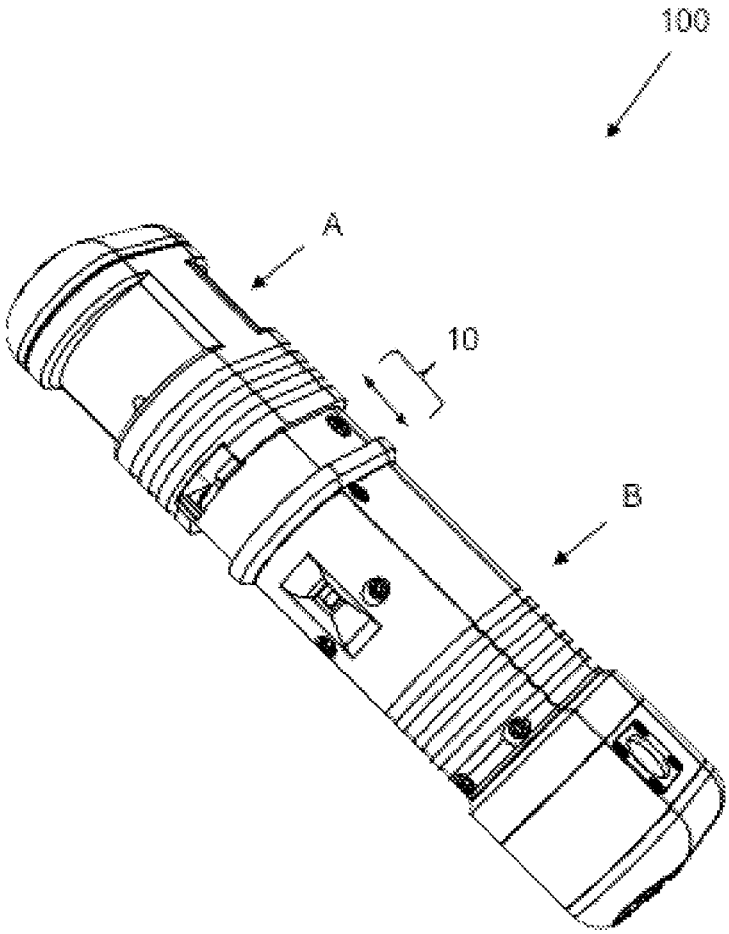
FIG. 1E illustrates the diversionary device with the sections pulled apart while being cocked.

The housing 100 may be constructed of any appropriate material although it is preferred that the material be lightweight. The housings of conventional diversionary devices are typically constructed of steel. While relatively strong, repeated use weakens the metal to such an extent that the number of reloads that is allowed is limited to prevent dangerous cracking or breaking. In contrast, in one embodiment of the diversionary device of the present invention, the housing 100 is constructed from aluminum. As illustrated in FIG. 1E, the device is cocked by pulling two spring-loaded sections A and B away from each other, then releasing it, moving internal components from a safe position into a cocked position. The double-headed arrow and bracket 10 in FIG. 1E indicate the approximate amount by which the two sections A and B are separated. Consequently, it is preferable that the housing include a gripping area 118 at least partially around the housing 100 near the front end 106 to aid cocking the device. Channels (such as those shown in FIGS. 1A and 1B), ridges or the like may also be formed in, on or around the outside of the housing for easier handling.

Figure 4A:
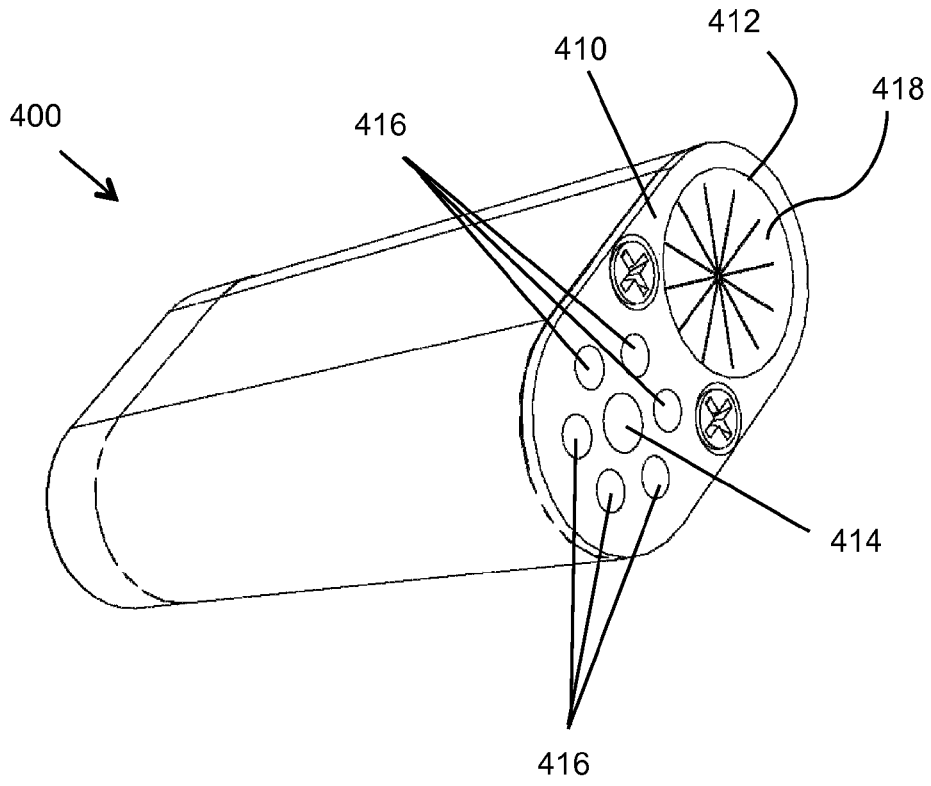
FIG. 4A is a perspective view of a cartridge of the present invention.

One feature of the diversionary device of the present invention is the ability to accept a removable cartridge into the housing (such as illustrated in FIG. 4A). The cartridge contains ignitable powder, primer and, in some embodiments, an oxidizer to enhance the flash and batteries to power the device. The ignitable powder may comprise powdered aluminum and the oxidizer comprise potassium perchlorate. It will be appreciated that other powders and oxidizers that affect the brightness and loudness may be used. To accommodate the cartridges, the rear section 500 opens, such as with a hinge 516, as illustrated in FIG. 5C and may be closed and secured to the rest of the housing 100 with a pull knob 518 capable of being screwed down, or otherwise secured, to the housing 100.

Figure 2:
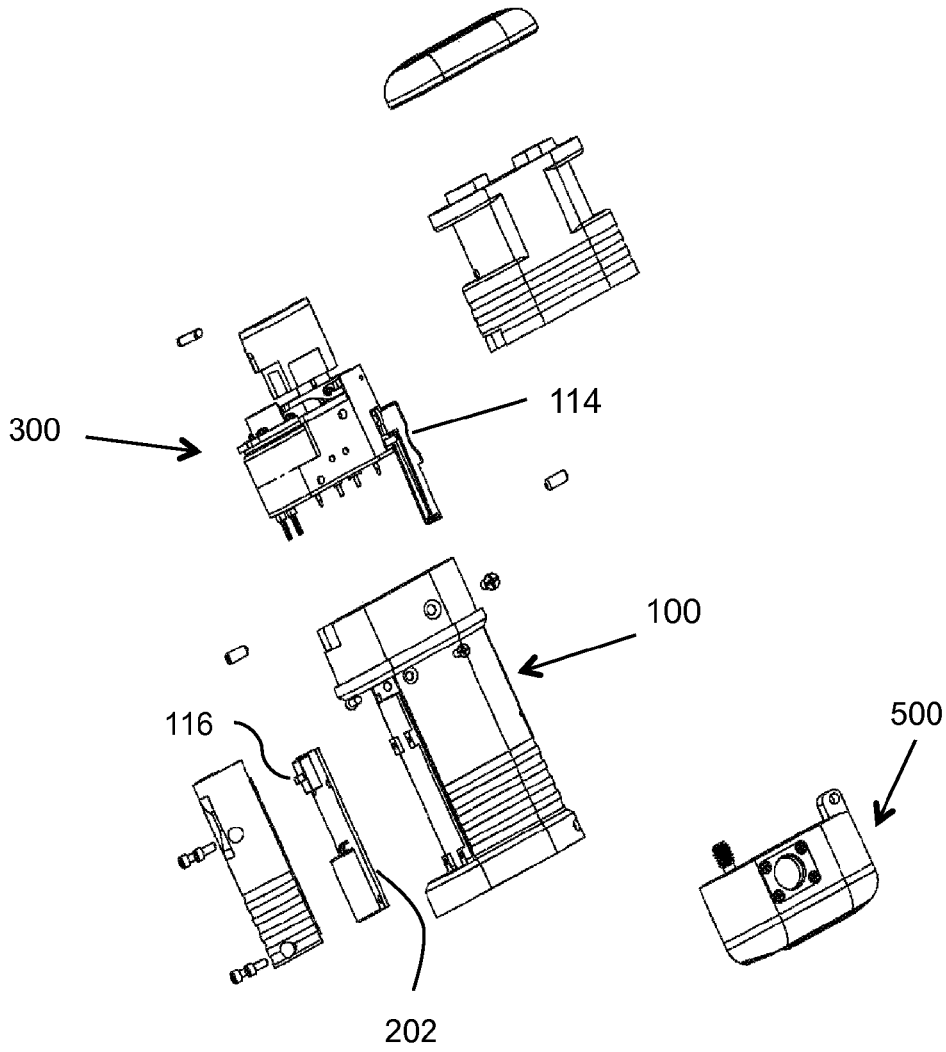
FIG. 2 is an exploded view of components within the housing of the diversionary device.

FIG. 2 is an exploded view of the components of the diversionary device within the housing 100. Shown are the rear section 500, the firing mechanism 300, the trigger bar 114 and a timing circuit board 202 to which the slide switch 116 is attached.

Firing Mechanism

Figure 3A:
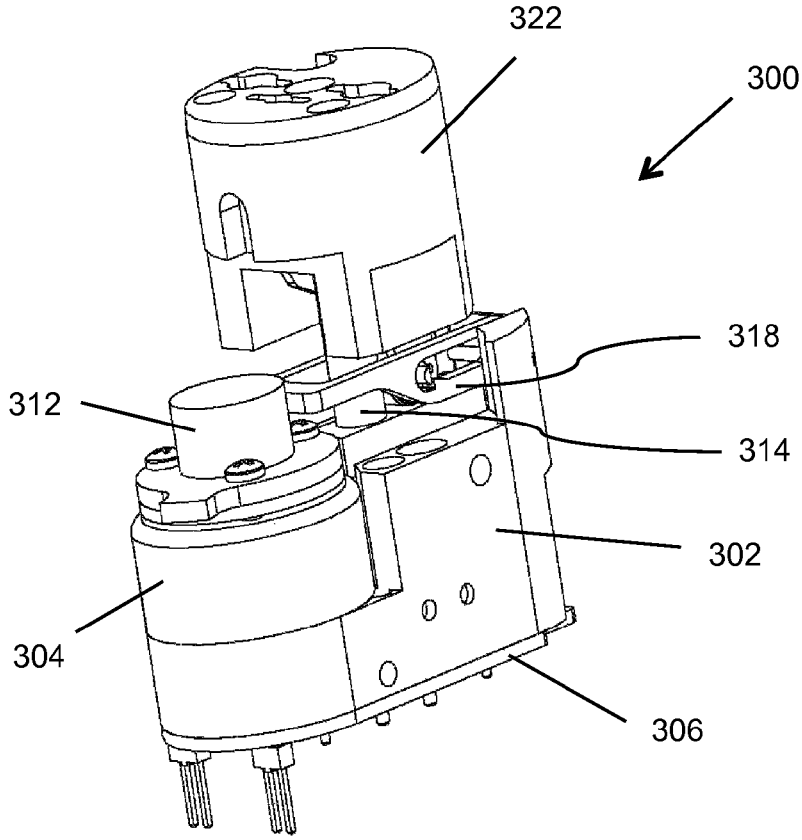
FIGS. 3A and 3B are perspective views of a trigger assembly of the present invention.
Figure 3B:
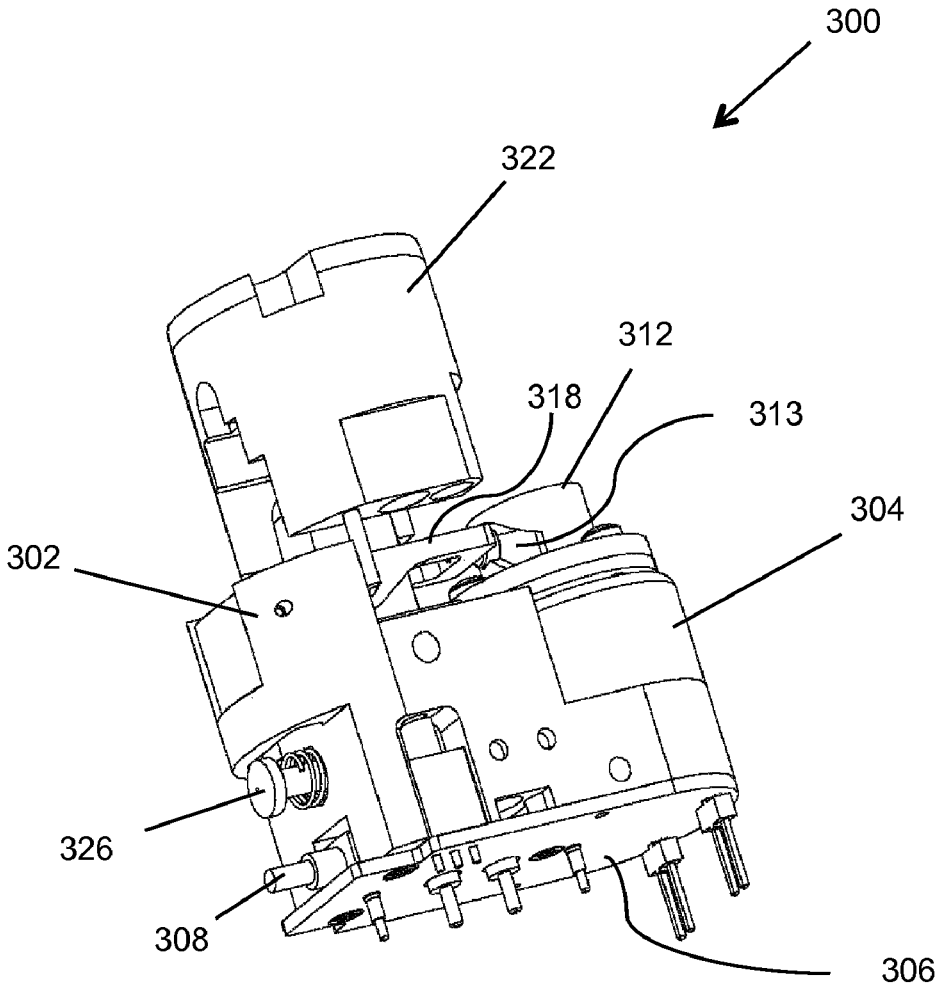
Figure 3C:
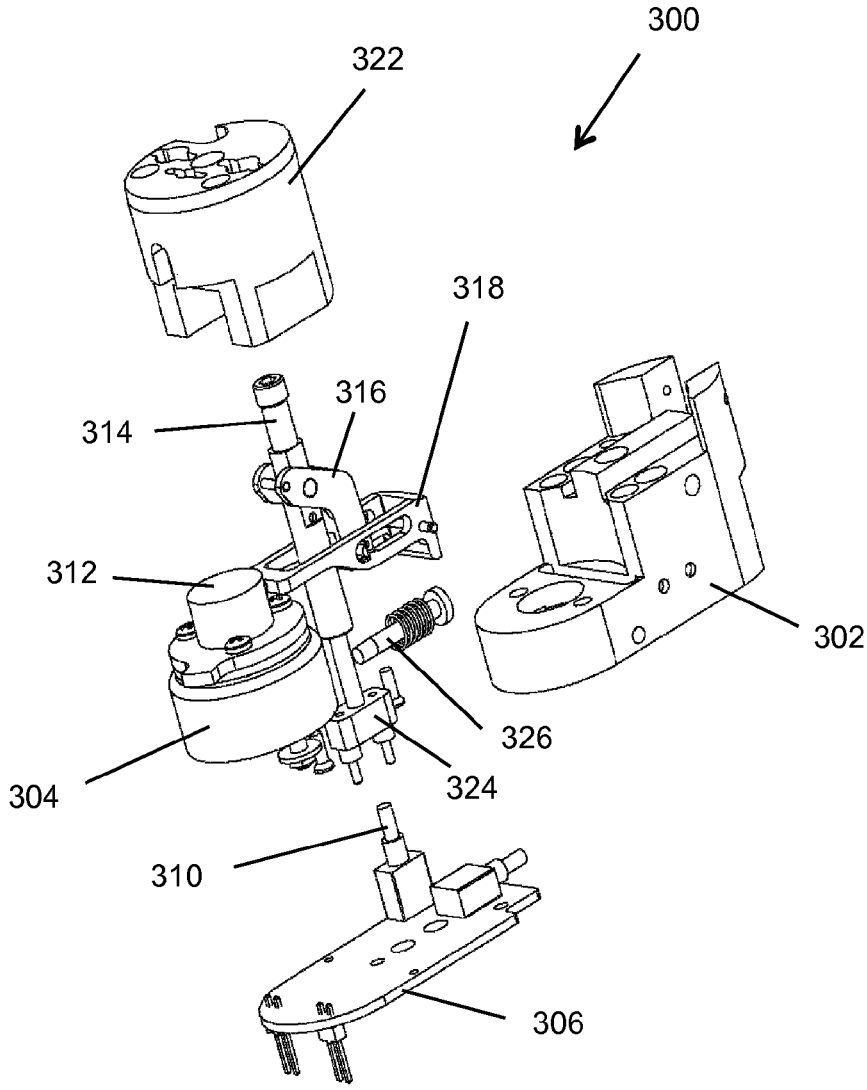
FIGS. 3C and 3D are exploded views of the trigger assembly.
Figure 3D:
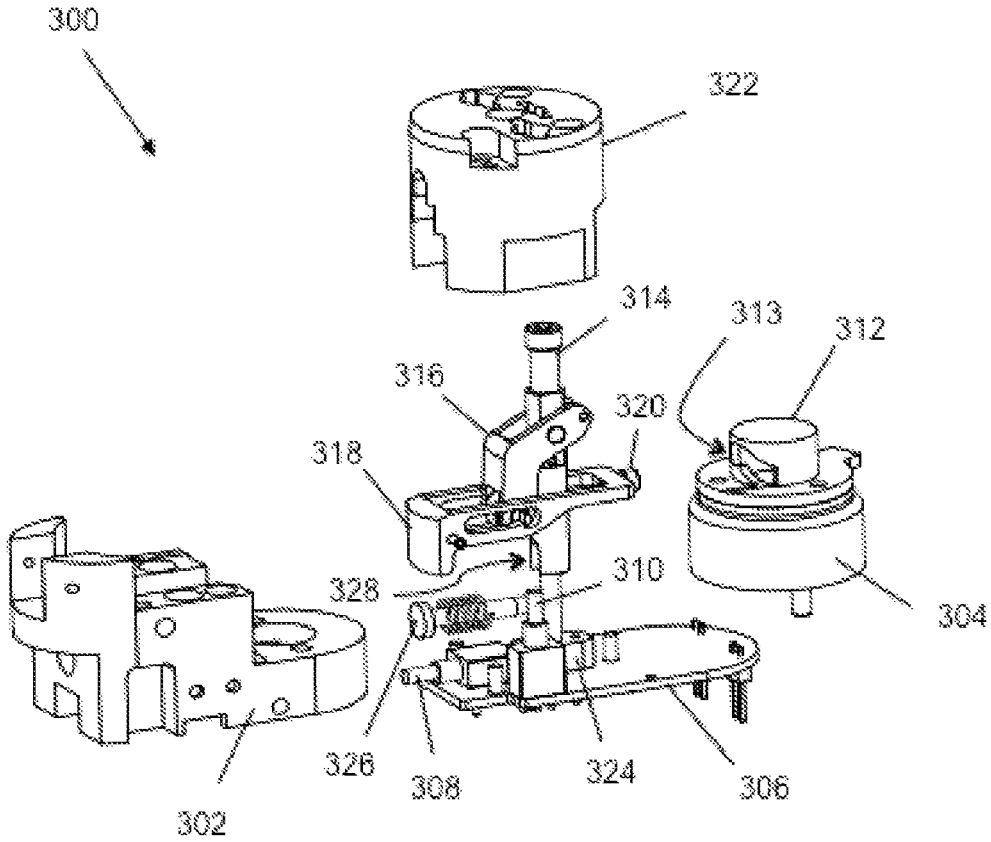

FIGS. 3A and 3B are perspective views of the firing mechanism 300 of the diversionary device of the present invention and FIGS. 3C and 3D exploded views. The firing mechanism includes a base or carrier 302 to which other components are directly or indirectly attached. A rotary solenoid 304 secured to a platform on the carrier 302 has a shaft (not shown) which rotates in an axis which is parallel to the x-x axis of the housing 100. Secured to the underside of the carrier 302 is a second printed circuit board 306 on which are mounted the trigger switch 308 and cutoff switch 310. The second printed circuit board 306 includes a first set of terminals which contact a power source in a removable cartridge and a second set of terminals which are electrically connected to corresponding terminals on the solenoid 304 to provide power thereto. The second printed circuit board 306 also includes a third set of terminals which are electrically connected to corresponding terminals on the first printed circuit board 202 to provide power thereto. When the device is not cocked, the cutoff switch 310 is in an open state (safe position), preventing the flow of current from the power source to the timing circuit board 222. When the device is cocked, the cutoff switch 310 is in a closed state. After the trigger switch 308 is released, current is allowed to flow to the timing circuit board 222, activating the rotary solenoid at the end of the predetermined timing delay.

Secured to the shaft of the rotary solenoid 304 is a cam 312. Instead of being secured directly to the shaft, the cam 312 may be secured to a turntable or other intermediate component(s) which is (are) secured to the shaft.

The firing mechanism 300 also includes a firing pin 314 positioned adjacent to the solenoid/cam assembly 304/312 and parallel to the x-x axis of the housing 100. The firing pin 314 is hingeably connected to a spring-loaded prop or link arm 316 which, in turn, is hingeably connected to a trip lever 318. The side of a top portion of the cam 312 facing the firing pin 314 and trip lever 318 has a diagonal cutout 313 into which a cam follower 320, secured to the trip lever 318, fits. Thus, when the rotary solenoid 304 is activated, the end of the trip lever 318 to which the cam follower 320 is attached is forced downward relative to the cam 312 while the opposite end of the trip lever 318 maintains a pivot point. This motion causes the spring-loaded prop 316 to release downward, in turn forcing the firing pin 314 downward also in a direction which is substantially orthogonal to the x-x axis from a cocked position to a fired position. The weight of a hammer 322 adds to the force with which the firing pin 314 moves. In one embodiment, the firing pin 314 directly or indirectly strikes a firing pin which, in turn, strikes one or more primers which accelerate pistons within the removable cartridge to begin the process of forcing an ignitable powder out of the cartridge. In the embodiment illustrated in FIG. 3, a splitter 324 is connected to or struck by the firing pin 314 which strikes primers to accelerate two parallel pistons in the cartridge, one piston to force the ignitable powder out of the cartridge and the other to force an oxidizer out of the cartridge to enhance the effects of the diversionary device. In another embodiment, the firing pin pierces a gas cylinder which releases gas to accelerate the pistons.

Because the motion of the rotary solenoid 304 is orthogonal to the motion of the firing pin 314, the firing mechanism 30 is unlikely to be accidentally activated. To further enhance the safety of the device, the firing mechanism 300 also includes a hammer block 326 which prevents accidental motion of the firing pin 314. One end of the hammer block 326 fits into a vertical slot 328 in the firing pin 314 and is biased away from the firing pin 314. The end of the hammer block 326 is maintained within the slot 328 in a safe position as long as the trigger bar 114 is in its forward locked or safe position. Sliding the trigger bar 114 away from the locked position towards the rear 108 of the housing, releases the hammer block 326 which disengages from the firing pin 314, allowing the firing pin 314 to move downward when the rotary solenoid 304 is activated.

Removable Cartridge

Figure 4B:
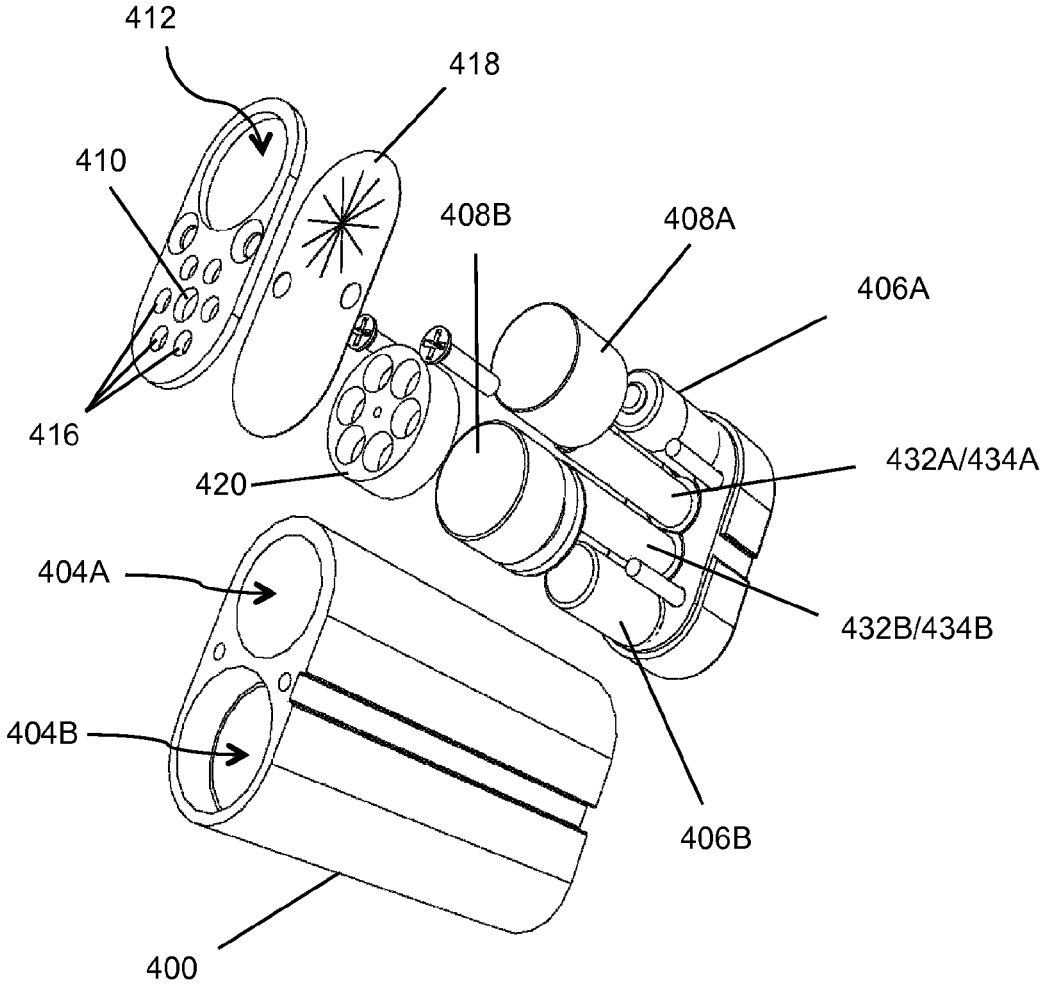
FIG. 4B is an exploded view of components of the cartridge.
Figure 4C:
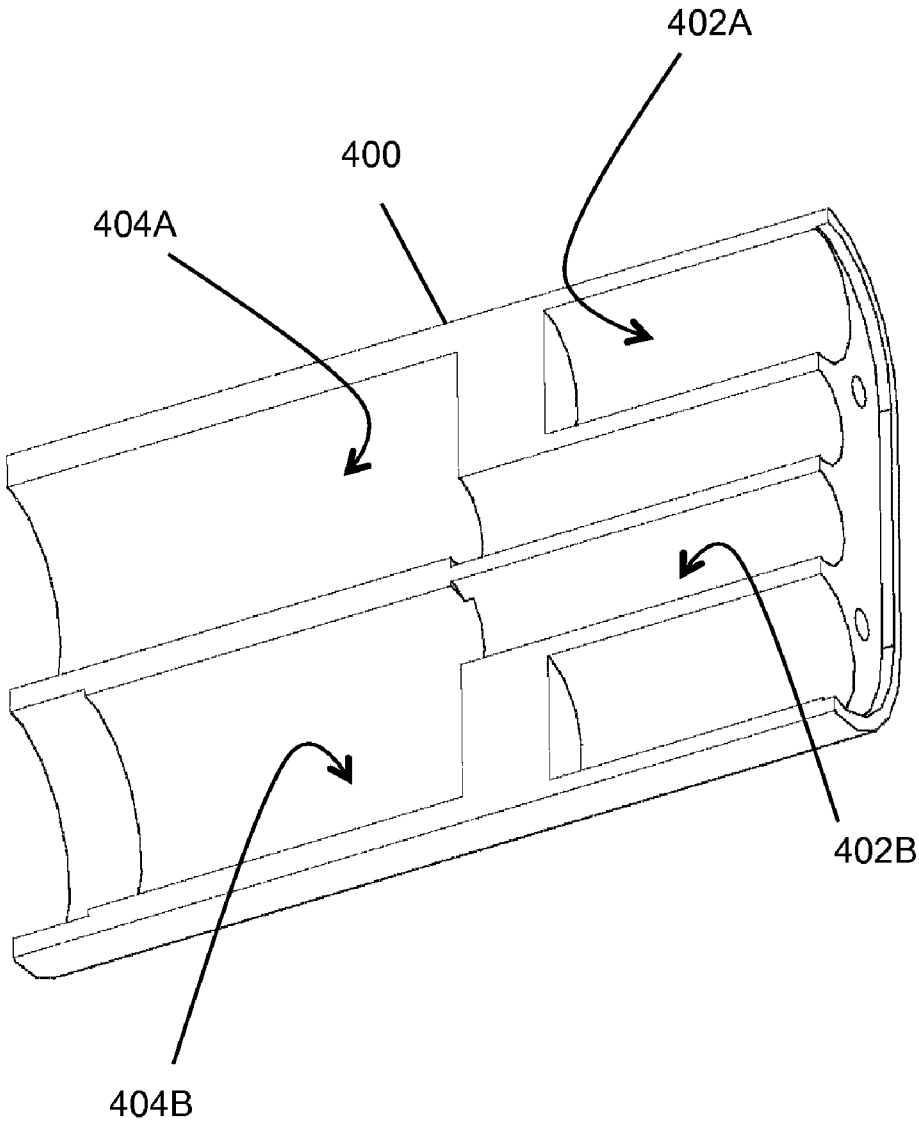
FIG. 4C is a cut-away view of the cartridge housing.
Figure 4D:
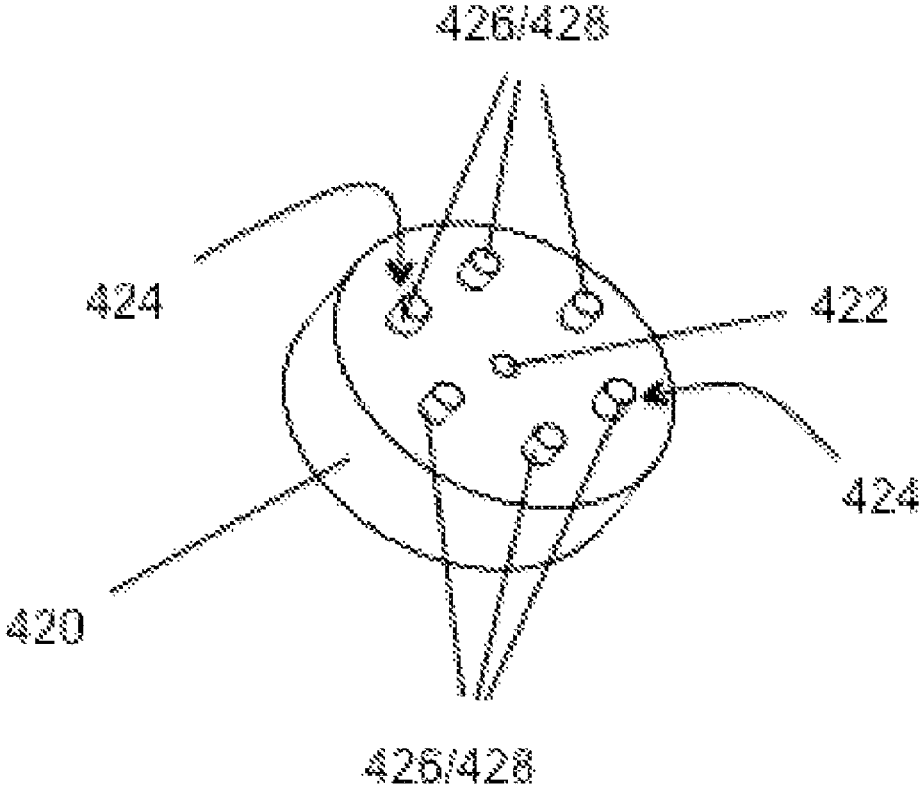
FIG. 4D is illustrates a primer mount used in the cartridge.

FIG. 4A is a perspective view of a removable cartridge body 400 which is inserted into the housing 100 when the end section 500 is opened, FIG. 4B is an exploded view of the components within the cartridge body 400, FIG. 4C is a cut-away view of the cartridge body 400 and FIG. 4D illustrates a primer mount 420 used in the cartridge body 400. The cartridge body 400 includes two sets of cylindrical chambers 402A, 402B and 404A, 404B formed therein. The chambers 402A, 402B in the first set are parallel to each other and formed partway through the front portion of the cartridge body 400 (the front and rear of the cartridge corresponding to the front 106 and rear 108 of the device housing 100) while the chambers 404A, 404B of the second set are parallel to each other and formed partway through the rear portion of the cartridge body 400. One or more batteries 406A, 406B may be installed in the first chambers 402A, 402B and used to power the diversionary device when the cartridge 400 is inserted into the housing 100. It will be appreciated that the scope of the present invention does not depend upon the number of batteries used or their electrical capacity.

The chambers 404A, 404B of the second set serve to hold the ignitable powder and the oxidizer, respectively. A piston 408A, 408B is positioned at the front of each chamber 404A, 404B. A cover plate 410 is secured to the rear end of the cartridge body 400. In one side of the cover plate 410, in line with one chamber 404A and the first piston 408A, is a circular opening 412. In the other side of the cover plate 410, in line with the other chamber 404B and the second piston 408B, is another, smaller circular opening 414 surrounded by further small circular openings 416. A breakable material 418, such as foil, provides a seal between the cover plate 410 and the cartridge body 400 to retain the powder and oxidizer within their respective chambers. Secured to the inside of the cover plate 410 is a primer mount 420 having a small, circular opening 422 formed therethrough in line with the central small opening 414 in the cover plate 410. This central opening 422 is surrounded by further small openings 424 (not all of which are labeled in FIG. 4D) in line with the surrounding openings 416 through the cover plate 410. Primers 426 are fitted inside each of the surrounding openings 422 against the breakable seal 418 and small firing pins 428 are then fitted into the openings 422, protruding out of the openings 422 (not all of the primers and firing pins are labeled in FIG. 4D).

The cartridge body 400 also includes a third set of parallel chambers 430A, 430B in which two primer tubes 432A, 432B are fitted. Shotgun primers 434A, 434B, or comparable devices, are fitted into the front ends of the primer tubes 422A, 432B and are ignited when the firing pin 314 (or splitter 324) strikes them. The resulting detonations force the pistons 408A, 408B rearward towards the cover plate 410. The first piston 408A forces the ignitable powder through the larger opening 412 of the cover plate 410 and through the breakable seal 418, into the rear section of the housing 100 and out one of the dispersion ports 502A, 502B, depending on the surface upon which the housing 100 is resting.

The second piston 408B forces the oxidizer through the small, central opening 422 in the cover plate 410 and through the breakable seal 418, into the rear section of the housing 100 and out one of the dispersion ports 502A, 502B. The second piston 408B also strikes the firing pins 428 which ignite the primers 426 whose ignition breaks the breakable seal 418 through the surrounding openings 416.

Preferably, the second piston 408B is heavier than the first piston 408A so that it moves more slowly. Thus, there is a slight delay, such as about 10 milliseconds for example, after the ignitable powder and oxidizer have been discharged out of the cartridge 400 and before the primers ignite. The delay allows the ignitable powder and oxidizer to mix and form a cloud outside and above the diversionary device before being ignited.

Dispersion Ports

Figure 5A:
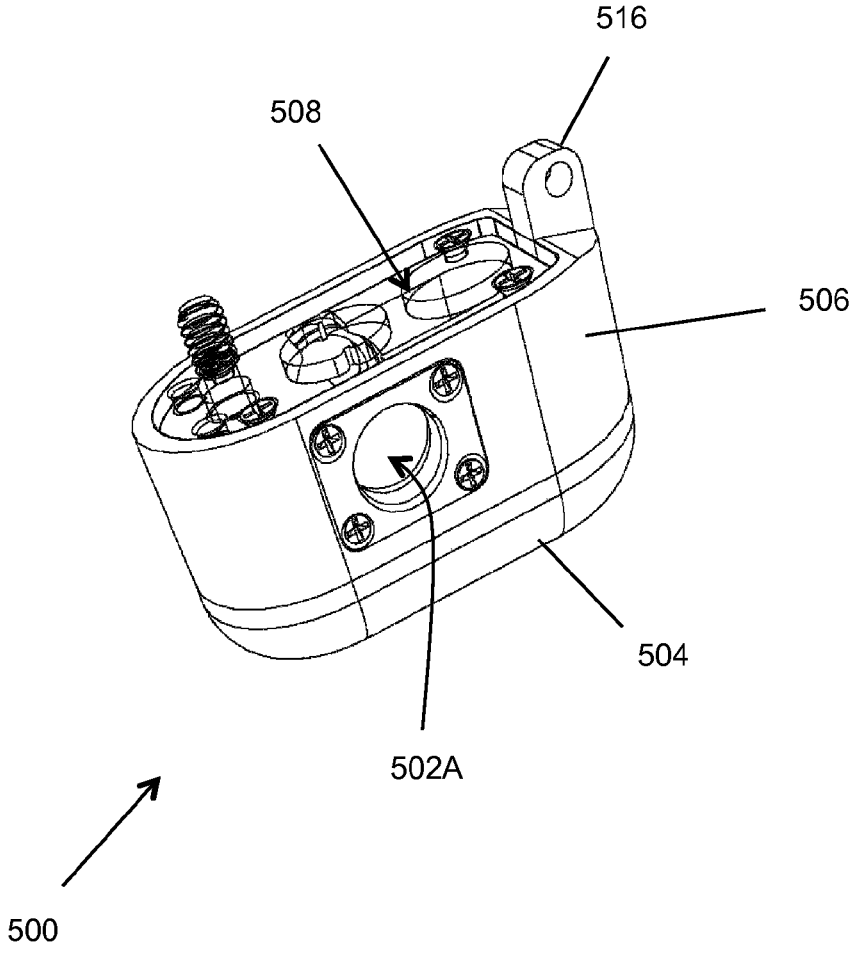
FIG. 5A is a perspective view of the dispersion end of diversionary device.
Figure 5B:
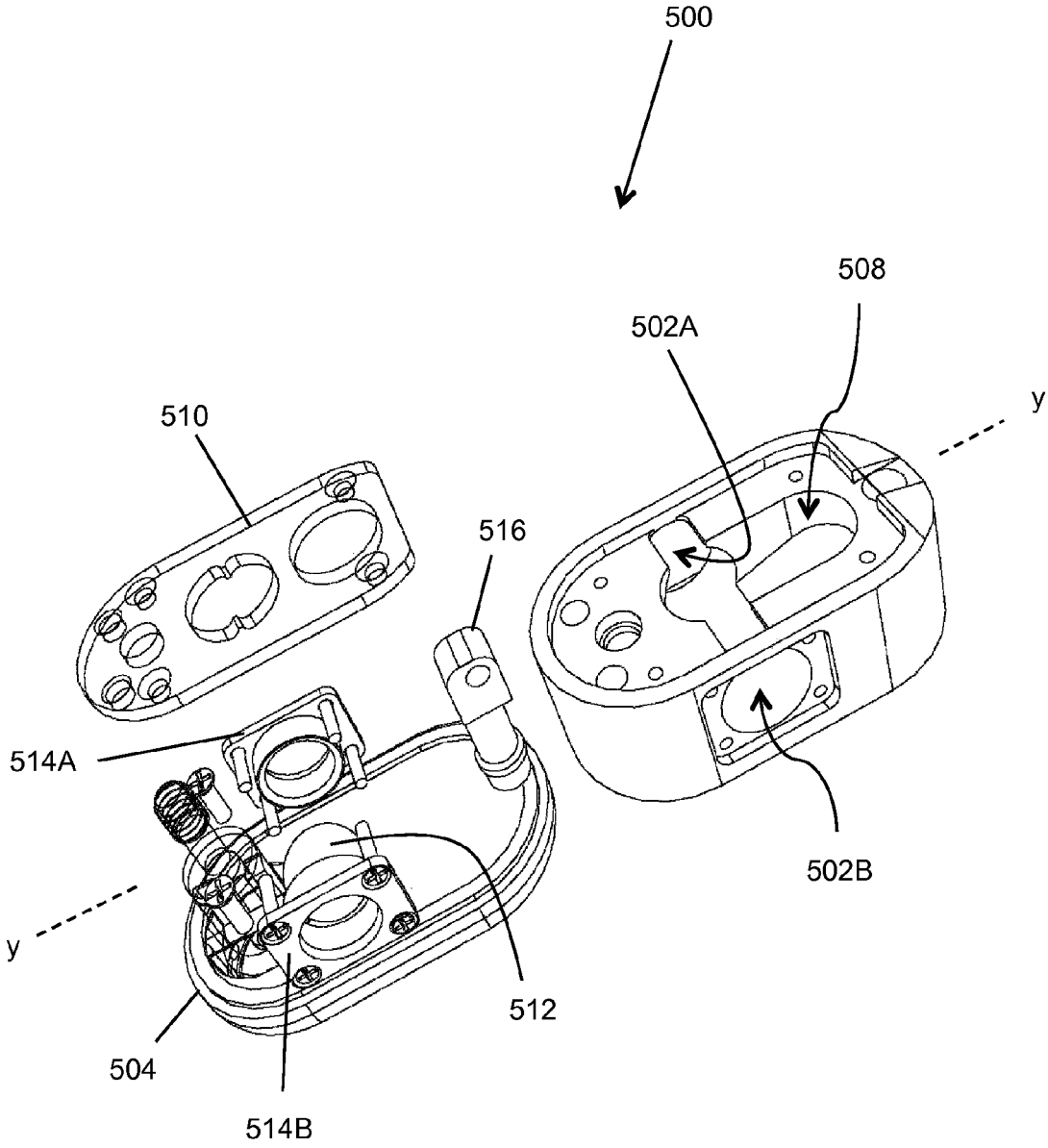
FIG. 5B is an exploded view of the rear section of the diversionary device.
Figure 5C:
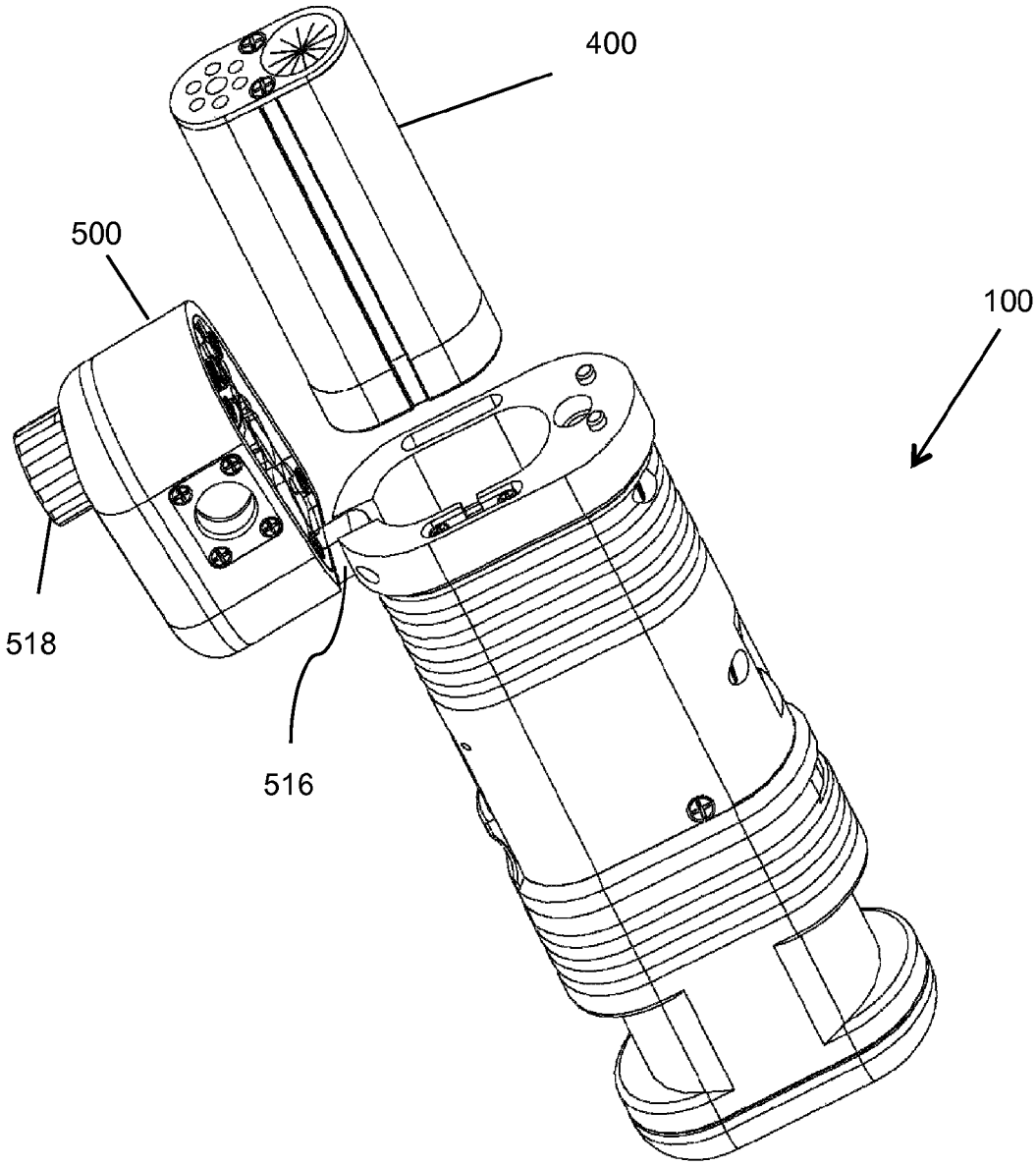
FIG. 5C illustrates the diversionary device in an unlatched position with a cartridge to be loaded.

FIG. 5A is a perspective view and FIG. 5B is an exploded view of the rear section 500 of the diversionary device. The rear section 500 includes an end cap or bumper 504, which preferably is a rubberized or other protective material, and a nozzle body 506. The nozzle body 506 has a circular opening 502 formed therethrough parallel with the z-z axis of the housing 100. The two ends of the opening 502 comprise the dispersion ports 502A, 502B. The inner end of the nozzle body 500 also has a cutout 508 which intersects the opening 502. To accommodate a removable cartridge with chambers for both an ignitable powder and an oxidizer, the cutout 508 may be oblong in the direction of the y-y axis. A strike plate 510 is secured to the inner end of the nozzle body 506. The strike plate 510 has two circular openings formed therethrough which align with the ends of the powder and oxidizer chambers 404A, 404B, thus allowing the contents of the chambers 404A, 404B to be discharged into the nozzle body and out of one of the two dispersion ports 502A, 502B. Preferably, the opening which aligns with the oxidizer chamber 404B is offset from the dispersion ports. As the oxidizer is discharged from the oxidizer, it is forced 90 degrees to the dispersion port. The rapid turn slows the oxidizer and creates turbulence, promoting high-speed mixing with the powder.

Figure 6:
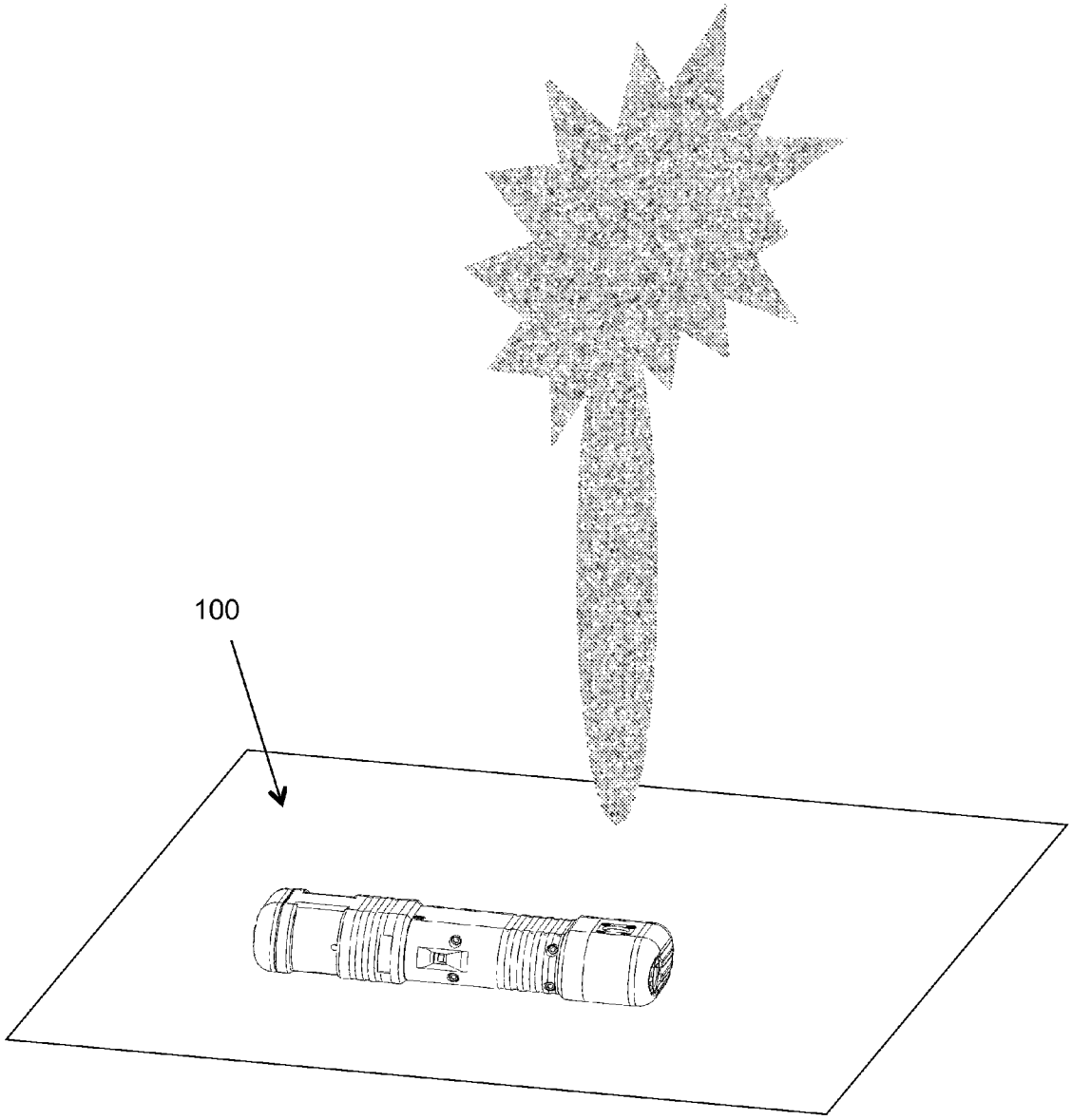
FIG. 6 illustrates the device on a floor with the cloud igniting above it.

As previously noted, the diversionary device of the present invention will come to rest on one of the two primary surfaces of the housing 100, either the top surface 102 or the bottom surface 104. The rear section 500 also includes a ball 512 within the opening 502. The ball 512 is kept within the opening 502 by retaining plates or grills 514A, 514B secured to the nozzle body 506 at the dispersion ports 502A, 502B, respectively. When the diversionary device is at rest on one of the two primary surfaces 102, 104, gravity causes the ball 512 to fall into what is then the lower part of the opening 502; that is, the part closest to the ground. The ball 512 then acts as a seal to prevent the ignitable powder and oxidizer from discharging out of what is the lower dispersion port. The powder and oxidizer, therefore, are forced out of what is then the upper dispersion port to form a cloud above the diversionary device and be ignited (FIG. 6). While other methods of sealing the lower dispersion port may be used, the ball 512 has the advantage of being relatively inexpensive to manufacture and is capable of withstanding the high temperatures and pressures which occur when the device is used.

To replace a cartridge, the rear section 500 may be completely removable from the main housing body 100 or may be opened on a hinge 516, as illustrated in FIG. 5C, and then secured with a pull-knob and screw 518 after the cartridge has been inserted.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application and to enable others of ordinary skill in the art to understand the invention for various embodiments with various modifications as are suited to the particular use contemplated.

What is claimed is:

1. A device for creating a diversion, comprising:

a housing elongated along a first axis, comprising:

first and second ends orthogonal to the first axis and having a width W and height H;

first and second primary sides, each primary side having a length L and a width W and being substantially parallel to the first axis and orthogonal to the first and second ends, the first and second primary sides extending from the first end to the second end;

first and second secondary sides, each secondary side having a length L and a height H and being substantially parallel to the first axis and orthogonal to the first and second ends and to the first and second primary sides, the first and second primary sides extending from the first end to the second end;

whereby L, W and H are selected such that when the device is thrown or dropped, the device will come to rest only on the first primary side or the second primary side;

the first primary side having a first circular dispersion port formed therethrough proximate to the first end, centered on a second axis orthogonal to the first axis, and parallel to the first and second primary sides;

the second primary side having a second circular dispersion port formed therethrough at the first end and aligned with the first dispersion port; and means within the housing for blocking the first dispersion port if the device comes to rest on the first primary surface and for blocking the second dispersion port if the device comes to rest on the second primary surface; and a firing mechanism within the housing and operable to discharge an ignitable composition out of a removable cartridge within the housing and through the first dispersion port when the device rests on the second primary side and through the second dispersion port when the device rests on the first primary side, whereupon the composition forms a cloud above the device and may be ignited.

2. The device of claim 1, further comprising a nozzle body within the housing at the first end, the nozzle body having:

an inside end facing the inside of the housing;

a cylindrical first opening formed therethrough centered on the first axis and aligned with the first and second dispersion ports; and a second opening formed in the inside end parallel to the first axis and intersecting the cylindrical first opening;

whereby when the ignitable composition is discharged out of the removable cartridge, the ignitable composition is propelled through the second opening and into the cylindrical first opening to be discharged through the first dispersion port when the device rests on the second primary side and through the second dispersion port when the device rests on the first primary side.

3. The device of claim 2, wherein:

the firing mechanism is further operable to discharge an oxidizer out of the removable cartridge; and the second opening formed in the inside end of the nozzle body is elongated to receive the discharged oxidizer and direct the discharged oxidizer through the first dispersion port when the device rests on the second primary side and through the second dispersion port when the device rests on the first primary side.

4. The device of claim 1, wherein the means for blocking comprises a spherical ball captured within a retaining structure and capable of moving along the second axis between the first dispersion port and the second dispersion port, whereby:

when the device comes to rest on the first primary side, the ball will block the first dispersion port and leave the second dispersion port open; and when the device comes to rest on the second primary side, the ball will block the second dispersion port and leave the first dispersion port open.

5. The device of claim 4, further comprising first and second grills secured to the nozzle body adjacent the first and second dispersion ports, respectively, the first and second grills both having an opening formed therethrough which has a diameter less than a diameter of the cylindrical first opening through the nozzle body, whereby the spherical ball is captured within the cylindrical first opening through the nozzle body.

6. The device of claim 4, wherein the spherical ball is formed from a tungsten-carbide material.

7. The device of claim 1, wherein the first end comprises a removable cover through which the cartridge may be inserted.

* * * * *